US006079224A

United States Patent [19]

Schehr

[11] Patent Number: 6,079,224

[45] Date of Patent: Jun. 27, 2000

[54] BODY-WORN ORNAMENT, BODY-WORN ORNAMENT KIT, AND METHOD OF ATTACHING A BODY-WORN ORNAMENT

[76] Inventor: Donna D. Schehr, 780 Carrington Blvd., Monroe, Mich. 48161

[21] Appl. No.: 09/088,261

[22] Filed: Jun. 1, 1998

[51] Int. Cl.[7] ..... A44C 7/00

[52] U.S. Cl. ..... 63/12; 63/14.1; 63/14.9; 63/DIG. 1

[58] Field of Search ..... 63/12, 14.1, 14.9, 63/DIG. 1

[56] References Cited

U.S. PATENT DOCUMENTS

| | | | |
|---|---|---|---|
| 1,140,975 | 5/1915 | Frankel | 2/1 |
| 1,971,216 | 8/1934 | Gould | 63/14.3 |
| 2,096,389 | 10/1937 | Bode | 428/42.2 |
| 2,292,024 | 8/1942 | Dreher . | |
| 2,364,872 | 12/1944 | Rich . | |
| 2,879,567 | 3/1959 | O'Connell . | |
| 2,936,600 | 5/1960 | Crigler . | |
| 2,975,538 | 3/1961 | Murfin . | |
| 3,176,364 | 4/1965 | Dritz | 24/304 |
| 3,614,876 | 10/1971 | Lenfant . | |
| 3,630,810 | 12/1971 | Mauro . | |
| 3,831,398 | 8/1974 | Davis, Sr. . | |
| 3,996,679 | 12/1976 | Warneke . | |
| 4,220,016 | 9/1980 | Frenger . | |
| 4,257,241 | 3/1981 | Voccio et al. . | |
| 4,411,263 | 10/1983 | Cook | 128/132 R |
| 4,724,684 | 2/1988 | Barnett . | |
| 4,783,974 | 11/1988 | Hernandez . | |
| 4,974,430 | 12/1990 | Turner . | |
| 4,996,851 | 3/1991 | Schinzinger et al. . | |
| 5,081,853 | 1/1992 | Salyer . | |
| 5,161,390 | 11/1992 | Sam . | |
| 5,181,397 | 1/1993 | Battista . | |
| 5,245,732 | 9/1993 | Johnston . | |
| 5,283,966 | 2/1994 | Rader et al. | 40/1.5 |
| 5,545,191 | 8/1996 | Mann et al. | 607/57 |
| 5,575,514 | 11/1996 | Troy | 293/340 |
| 5,638,701 | 6/1997 | Dempsey | 63/12 |
| 5,769,995 | 6/1998 | Greyerbiehl | 156/250 |

FOREIGN PATENT DOCUMENTS

| | | | |
|---|---|---|---|
| WO 91/11934 | 8/1991 | WIPO | 63/12 |

*Primary Examiner*—Terry Lee Melius
*Assistant Examiner*—Andrea Chop
*Attorney, Agent, or Firm*—MacMillan, Sobanski & Todd, LLC

[57] ABSTRACT

An ornament comprises a decorative element and a hook-and-loop-type fastener for removably attaching the decorative element to a wearer's body. A first portion of the hook-and-loop-type fastener has fastening elements extending from one side thereof and an adhesive element is attached to another side. A release paper covers the adhesive element. A second portion of the hook-and-loop-type fastener has fastening elements extending from one side thereof and an adhesive element is attached to another side. The adhesive element on the second portion of the hook-and-loop-type fastener is removably attachable to a rear portion of the decorative element. Upon removal of the release paper, the adhesive surface of the first portion of the hook-and-loop-type fastener is attachable to a wearer's body. After attaching the first portion to the wearer's body, the second portion of the hook-and-loop-type fastener is engageable with the first portion to removably engage the decorative element with the wearer's body. Multiple decorative elements and fasteners are provided for use with the ornament. A method of attaching the ornament for removably securing a body-worn ornament to a wearer's body comprises the steps of providing an ornament, removably attaching a hook portion of the hook-and-loop-type fastener to a wearer's body and releasably engaging the loop portion of the hook-and-loop-type fastener with the hook portion.

20 Claims, 3 Drawing Sheets

BODY-WORN ORNAMENT, BODY-WORN ORNAMENT KIT, AND METHOD OF ATTACHING A BODY-WORN ORNAMENT

BACKGROUND OF THE INVENTION

The present invention relates generally to jewelry. More particularly, the invention relates to a removable body-worn ornament, which uses a hook-and-loop-type fastener to fasten the body-worn ornament to a wearer's skin and a method for releasably attaching the body-worn ornament to the wearer's skin.

Ear ornaments are the most common types of body-worn ornaments. An ear ornament is an ornament of jewelry that is worn on a wearer's earlobe. Ear ornaments have been worn on the earlobe of wearers throughout the ages. Such ornaments are commonly referred to as earrings. Attachment devices for attaching the earring to the wearer's earlobe are well known. Clasps or clamps pinch the earlobe. Clamps, in particular, are commonly screwed tightly against the earlobe which is composed of a tough areola and adipose tissue that is not very firm. Clamps are often uncomfortable when the screw is tightened too tight. On the other hand, when the screw is not tight enough, the ear ornament can become detached and lost. Even a tightly affixed clamp may become detached. Further, the bulkiness of the clamp detracts from the dainty, cosmetic appearance of the ornament.

Posts and loops or wires or pins provide alternative attachment devices to the clips or clamps. Posts or loops that are engageable with an opening or hole pierced through the wearer's earlobe. Clutch connectors are engageable with the post to prevent the post from inadvertently disengaging the earlobe. Although such attachment devices are smaller than clasps and clamps and hence, render the ear ornament more cosmetically acceptable in appearance, a person cannot wear an ear ornament supported by such a device until the earlobe has been surgically pierced. Since some people are opposed to having their earlobes pierced, not everyone can wear an ear ornament supported by a post or pin. For those who do decide to have their earlobes pierced, there is associated with the piercing a certain degree of pain and the resulting hole must be kept clean to avoid infection or closing of the hole. Finally, although an ear ornament attached by a post or pin is generally more secure than one attached by a clamp, ornaments attached by posts or pins suffer a real disadvantage. Should the ear ornament become caught, or should someone pull on the ear ornament, the earlobe of the wearer may become painfully torn since the ear ornament will not readily detach.

Regardless of the attachment device employed, these attachment devices can be uncomfortable to the wearer of the ear ornament. These devices can also interfere with the wearer's routine living conditions, such as the use of head apparel, such as snug-fitting hats, earmuffs, and the like, the use of headphones or a telephone handsets, and other times when the ear ornament clip, post or loop is pressed back against the tender tissue behind the earlobe. The foregoing attachment devices and most particularly, posts and loops can also tug at the earlobe when worn by the wearer. In fact, children who get their ears pierced at a very early age for receiving posts or loops of ear ornaments often suffer with unsightly, overly-stretched openings in their earlobes later in life. Ear ornaments that do not interfere with common living conditions or tug on the earlobes or cause unsightly stretching of openings in the earlobes are desired.

In addition to the foregoing deficiencies, operation of clamps and clutch connectors (engageable with ear ornament posts) may be difficult to negotiate for people, especially for children whose motor skills have not fully developed, or elderly who suffer with arthritis or similar conditions that involve loss of motor skills or who may have conditions that impair visual acuity, particularly at close distances. In providing car ornament fasteners, it is important to meet the needs of people who experience these difficulties by providing a fastener that effortlessly attaches the ear ornament to the earlobe.

Accordingly, there exists a need for an attractive, safe ear ornament that may be easily affixed to an earlobe without the necessity of clamps or post, or having the earlobe pierced. Such an ear ornament must be capable of being comfortably and tightly secured to the earlobe with minimum effort.

Alternatives to uncomfortable mechanical attachment devices for ear ornaments are well known. One such alternative is described in U.S. Pat. No. 2,362,872, issued to Cheri Rich. The Rich patent describes a non-metallic ear ornament having a fastening element on the back of the ear ornament. Adhesive tape engages the fastening element and is adapted to adhere to an earlobe.

U.S. Pat. No. 2,936,600, issued to Ilene M. Crigler, describes another ear ornament attachment device that secures the ear ornament to the ear by adhesion. Similar to the Rich patent set forth above, the attachment device described in the Crigler patent employs adhesive tape. Unlike the Rich patent, however, the Crigler patent describes the incorporation of a coupling portion of the ear ornament. The invention described in the Crigler patent includes a body portion having an adhesive backing. The adhesive backing is protected with a covering that is adapted to be stripped off just prior to applying the attachment device to a wearer's ear. A coupling portion is fashioned integrally with the body portion. The coupling portion is provided with an opening. Any desired ear ornament provided with a coupling hook may be coupled to the tab by simply passing the coupling through the opening in the tab. Alternatively, the coupling portion may be provided with a hook rather than an opening.

Another adhesively secured ear ornament is described in U.S. Pat. No. 4,974,430, issued to Sue S. Turner. The Turner patent discloses a strip of pliant material having adhesive on at least some portion of both sides of the strip for securing the strip to the earlobe and for securing an ornament to the strip. Alternatively, portions of one side of the strips may have adhesive for securing the strip to the earlobe and perforations may be provided in the strip for accommodating a post or wire of an ear ornament. The portions of the strip having an adhesive coating may be further provided with a releasable covering.

U.S. Pat. No. 5,081,853, issued to Amy L. Salyer, describes yet another adhesively securable ear ornament. The ornament described in this patent includes a decorative portion, a heat and cold insulating soft-felt backing, and a piece of two-sided adhesive-like tape. The felt backing is permanently secured to the decorative portion. The two-sided adhesive-like tape is overlaid on top of the felt backing. When desired to be worn, the wearer removes a paper covering to expose an exterior side of the adhesive-like tape to reveal the sticky adhesive. The ear ornament can then be pressed tightly against the ear and secured in place. For subsequent use, the used piece of adhesive-like tape can be removed and replaced with a new piece of adhesive-like tape, or a new piece of adhesive-like tape can be overlaid on top of the used piece of adhesive-like tape.

SUMMARY OF THE INVENTION

The present invention is an ornament that comprises a decorative element and a hook-and-loop-type fastener for removably attaching the decorative element to a wearer's body or skin. A first portion of the hook-and-loop-type fastener has fastening elements extending from one side and an adhesive element is attached to another side. A release paper covers the adhesive element. A second portion of the hook-and-loop-type fastener has fastening elements extending from one side and an adhesive element is attached to another side. The adhesive element on the second portion is removably attachable to a rear portion of the decorative element. Upon removal of the release paper, the adhesive surface of the first portion of the hook-and-loop-type fastener is attachable to a wearer's body. After attaching the first portion to the wearer's body, the second portion of the hook-and-loop-type fastener is engageable with the first portion to removably engage the decorative element with the wearer's body. The invention also encompasses multiple decorative elements and fasteners for use with the ornament. Further, the invention includes a method of attaching the ornament.

DETAILED DESCRIPTION OF THE PREFERRED EMBODIMENT

Figure 1:
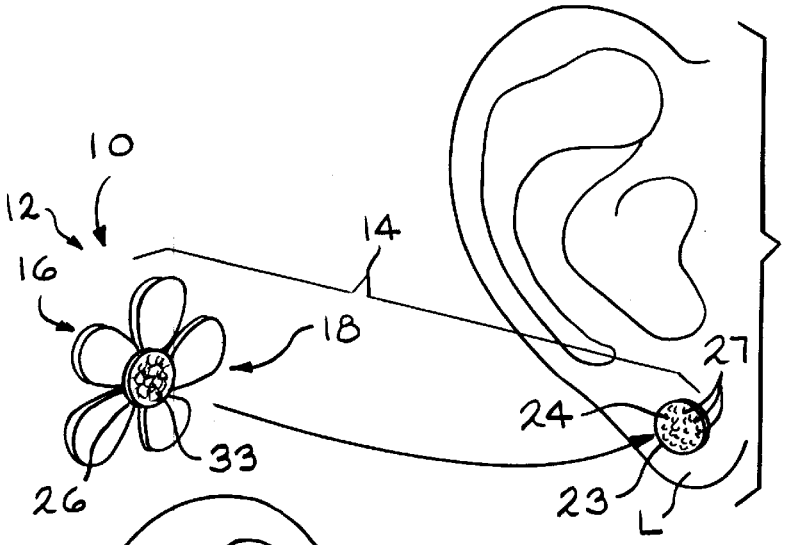
FIG. 1 is an environmental partially exploded perspective view of a body-worn ornament according to the present invention detached from a wearer's body.
Figure 2:
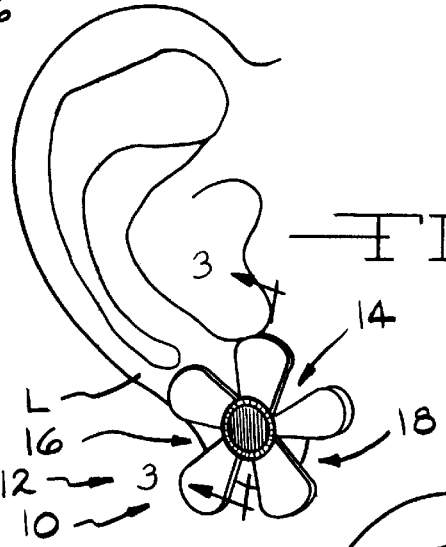
FIG. 2 is an environmental front perspective view of the ornament shown in FIG. 1, further shown attached to the wearer's body.
Figure 3:
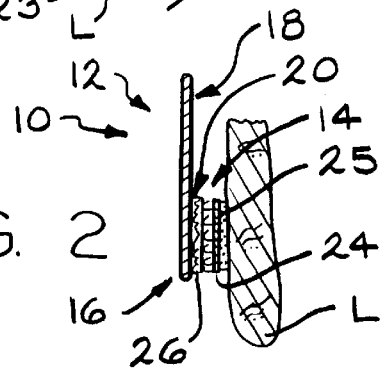
FIG. 3 is an environmental cross sectional view of the ornament taken along the lines 3—3 in FIG. 2.
Figure 4:
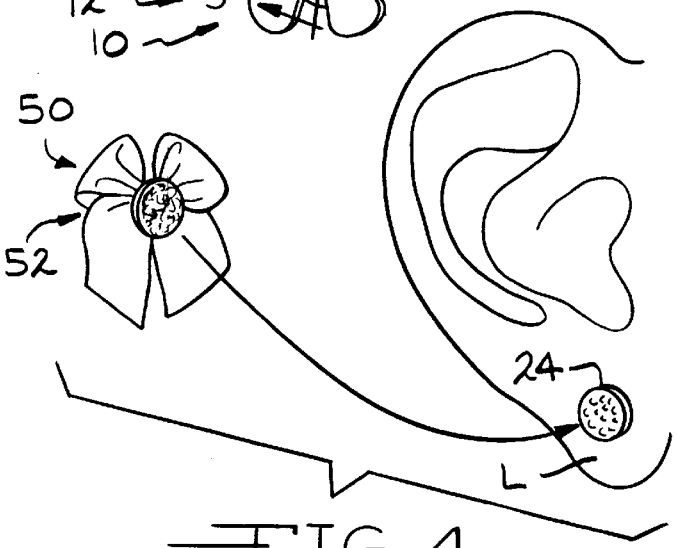
FIG. 4 is an environmental partially exploded perspective view of another ornament according to the present invention detached from a wearer's body.
Figure 5:
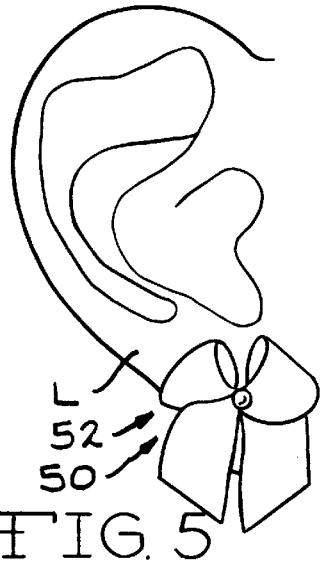
FIG. 5 is an environmental front perspective view of the ornament shown in FIG. 4 further shown attached to the wearer's body.

Referring now to the drawings, there is illustrated in FIGS. 1 through 3 a body-worn ornament, specifically an ear ornament according to the present invention, indicated generally at 10. The ear ornament 10 comprises a decorative element 12 and a fastener 14. A forward portion 16 of the decorative element 12 is, as its name presents, decorative or ornamental in character so as to be aesthetically appealing when worn. The decorative element 12 is preferably fabricated from a lightweight material, such as a cloth fabric, or a combination of lightweight materials, such as cloth fabric, plastic, and glass beads. It is preferable that the materials be lightweight so as to be easily supported on the earlobe L (shown in FIGS. 2 through 5), by the fastener 14, which will be described in detail below. It is also preferable that the materials be stain resistant and/or washable so as to remain presentable over the useful life of the ear ornament 10. The decorative element 12 can be bright and colorful so as to captire the eye of one viewing the ear ornament 10. FIGS. 1 through 3 show an example of an ear ornament 10 having a decorative element 12 in the form of a flower. FIGS. 4 and 5 show a second embodiment of an ear ornament according to the invention, indicated generally at 50. The ear ornament 50 includes a decorative element 52 in the form of a bow with an artificial pearl or a cloudy glass bead located at a central portion of the bow. It will be appreciated from these examples, and the preceding discussion that the decorative element of an ear ornament according to the invention may be formed of one or more sub-elements, and may be formed of various suitable materials.

Continuing with reference to FIGS. 1 through 3, a rear portion 18 of the decorative element 12 of the ear ornament 10 has a support region 20 for supporting the fastener 14, or at least a portion of the fastener 14. Although this region 20 is centrally located in both embodiments shown, the support region 20 can be located elsewhere on the rear portion 18 of the decorative element 12 of the ear ornament 10.

The fastener 14 is a hook-and-loop-type fastener having a hook portion 24 and a loop portion 26. The hook portion 24 and the loop portion 26 are preferably pliable so as to conform to the contours of a wearer's earlobe L, as will become more apparent in the description below. The hook portion 24 has a first side 23, shown in FIG. 1, and a relatively smooth second side 25, shown in FIG. 3. The components and arrangement of the hook portion 24 and the loop portion 26 are more clearly shown in the exploded view of the fastener 14 illustrated in FIG. 6.

The hook portion 24 of the fastener 14 includes a plurality of hook elements 27 which extend from the first side 23. The second side 25 of the hook portion 24 is releasably attachable to the earlobe L of the wearer in a manner which will be described below. The loop portion 26 of the fastener 14 has a first side 29 and a second side 31, also shown more clearly in FIG. 6. A plurality of loop elements 33 extend from the first side 29 of the loop portion 26. The second side 31 of the loop portion 26 is attachable to the support region 20 of the rear portion 18 of the decorative element 12 in a manner which will be described below.

In the embodiment of the ear ornament 10 illustrated in FIGS. 1 through 3, the loop portion 26 is fixed to the decorative element 12 with the relatively soft and pliable loop elements 33 facing outwardly. The smooth second side 25 of the hook portion 24 is fixed to the wearer's earlobe L. To attach the decorative element to the wearer's earlobe L, the wearer will align the loop portion 26 with the hook portion 24 affixed to the wearer's earlobe L and press the loop portion 26 against the hook portion 24 to cause the hook elements 27 to engage and releasably retain the loop elements 33 of the loop portion 26. Thus, the relatively stiff hook elements 27 of the hook portion 24 extend away from the wearer's earlobe L, and cannot irritate the skin of the wearer when wearing the ear ornament 10. The hook portion 24 and the loop portion 26 are thus easy to fasten and comfortable to wear.

The hook portion 24 and the loop portion 26 should be small enough to fit on earlobe L. It is preferable that these portions 24 and 26 be small enough to be concealed by the decorative element 12 when the ear ornament 10 is being worn. Moreover, the hook portion 24 and the loop portion 26 should be large enough to sufficiently support the decorative element 12 of the ear ornament 10 on the earlobe L when the ear ornament 10 is worn.

The hook portion 24 is attached to the earlobe L and the loop portion 26 is attached to decorative element 12 of the ear ornament 10 with suitable adhesive materials. One preferred adhesive material is in the form of adhesive elements, namely, a first adhesive element 28 and a second adhesive element 30. Although the adhesive elements 28 and 30 may each be in other forms, pieces of pressure-sensitive double-sided adhesive coated tape are preferred. The adhesive element 28 has two opposing sides, each defining an adhesive surface. A first adhesive surface 32 of the first adhesive element 28 is affixed to the hook portion 24. A second adhesive surface 34 of the first adhesive element 28 is normally supplied to the wearer covered with a removable release tape or paper 36. In the illustrated embodiment, the second adhesive element 30 also has two opposing sides, each defining an adhesive surface. The second adhesive element 30 has a first adhesive surface 38 affixed to the loop portion 26 of the fastener 14 and a second adhesive surface 40 affixed to the support region 20 on the rear portion 18 of the decorative element 12. It should be noted that, as indicated above, the adhesive elements 28 and 30 may each be in other forms than double-sided adhesive coated tape. For example, instead of tape, the adhesive elements 28 and 30 may be unitary layers of adhesive fixed, respectively, to the hook portion 24 and to the loop portion 26. It is also anticipated, for example, certain types of decorative elements 12 could not be fastened securely enough with double-sided adhesive coated tape to the loop portion 26 to satisfy some wearers. Thus, it is anticipated that the second adhesive element 30 may be a strong, permanent adhesive, such as hot-melt glue, to more securely fasten the loop portion 26 to the decorative element 12.

To attach the ear ornament 10 of the illustrated embodiment, the release paper 36 is removed from the first adhesive element 28, to expose the sticky adhesive surface 34 beneath. The adhesive surface 34 of the first adhesive element 28 is then pressed onto the earlobe L in a desired location, to mount the hook portion 24 to the earlobe L at the desired location, as is clearly shown in FIG. 1. Subsequently, the loop portion 26 is engaged with the hook portion 24 of the fastener 14 to attach the decorative element 12 of the ear ornament 10 to the earlobe L of the wearer. Of course, the adhesive elements 28 and 30 are preferably each formed of harmless, nontoxic adhesive materials.

Figure 6:
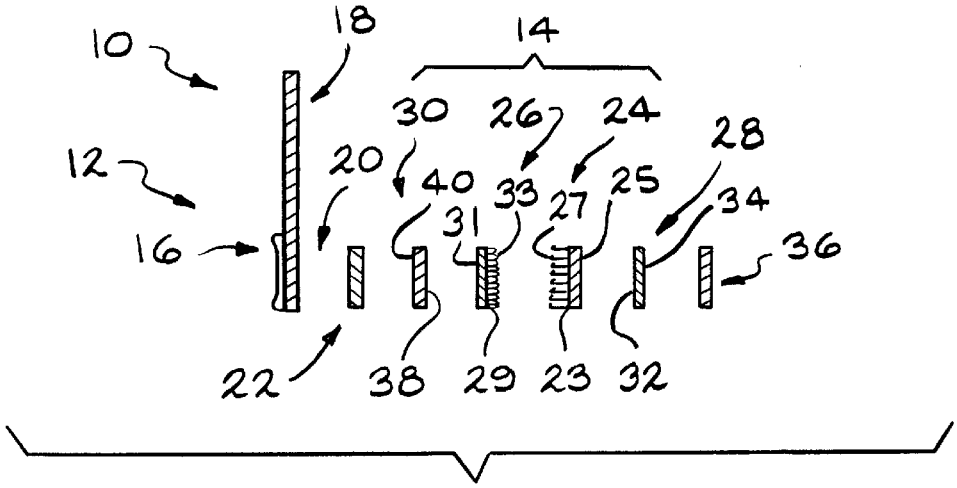
FIG. 6 is an exploded sectional view of the ornament shown in FIGS. 1 through 3.

As shown in the exploded view of FIG. 6, a disk or plate-like member 22 can be affixed to the support region 20 on the rear portion 18 of the decorative element 12 of the ear ornament 10. The plate-like member 22 provides support for the loop portion 26 of the fastener 14. The plate-like member 22 may be affixed to the decorative element 12 in any suitable manner including, but not limited to, the use of an adhesive element similar to the adhesive elements 28 and 30 set forth above. The plate-like member 22 is fabricated from a material suitable for engagement with the second adhesive element 30 so as to be adaptable to support the loop portion 26. Metal and plastic are examples of some suitable materials from which the plate-like member 22 may be formed. The plate-like member 22 provides planar support for the loop portion 26 affixed thereto, preventing the loop portion 26 on otherwise very flexible decorative elements 12 from folding, thereby enhancing the ease of attachment of the loop portion 26 to the hook portion 24 attached to the earlobe L.

It may be preferable that the fastener 14 and the adhesive elements 28 and 30 arc neutral in color, or substantially colorless, so as to be substantially unnoticed or at least unobtrusive against the earlobe L when the ear ornament 10 is worn by the wearer. Alternatively, the fastener 14 and the adhesive elements 28 and 30 may be provided in a variety of colors and shades. The availability of multiple colors would, for instance, enable a wearer to closely match the fastener 14 to the wearer's skin color, or to match a predominant color of the decorative element 12 of the ear ornament 10.

Figure 7:
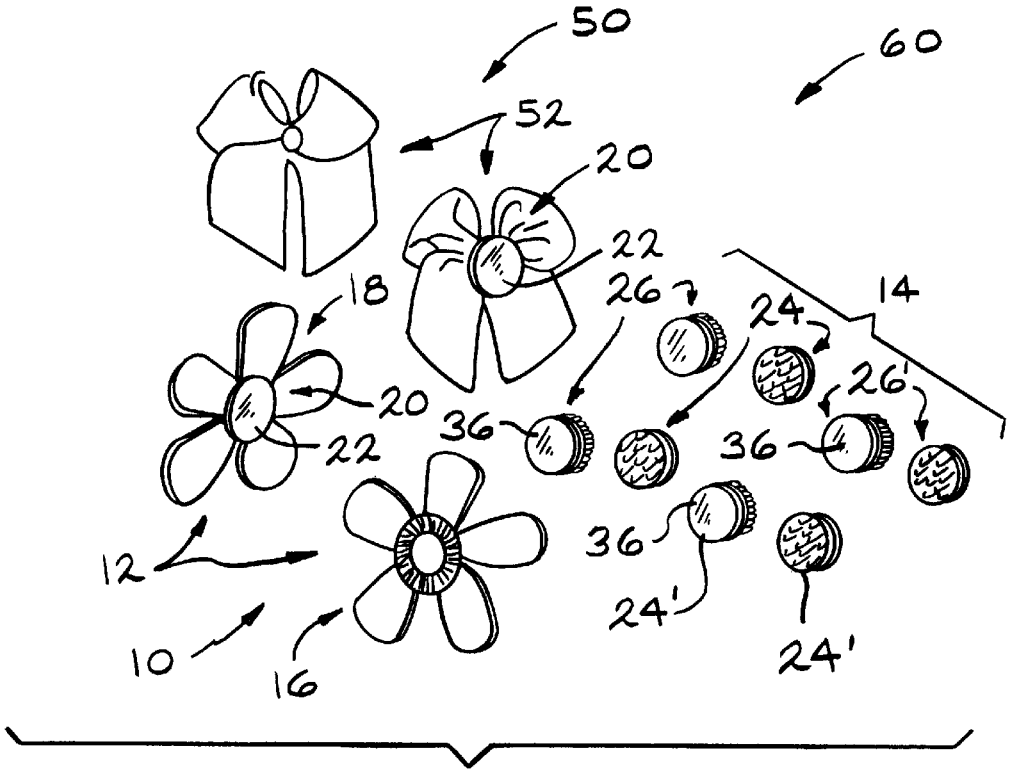
FIG. 7 is a front perspective view of a body-worn ornament kit.

Referring now to FIG. 7, the hook portion 24 and the loop portion 26 of the fastener 14 are preferably replaceable. That is to say, it is preferable that the hook portion 24 be replaceable with replacement hook portions 24', as shown in FIG. 7, to permit the decorative element 12 of the ear ornament 10 to be reused over and over. Similarly, the loop portion 26 may be replaceable with replacement loop portions 26' to further insure that the decorative element 12 of the ear ornament 10 may be reused.

The hook portion 24 is easy to affix to the earlobe L and the loop portion 26 is equally easy to affix to the decorative element 12 of the ear ornament 10. Replacement hook and loop portions 24' and 26' are likewise easy to attach to the earlobe L and the decorative element 12 of the ear ornament 10, making the entire ear ornament 10 easy to assemble. Moreover, decorative elements of the ear ornaments, such as the decorative element 12 shown in FIGS. 1 through 3 and the decorative element 52 shown in FIGS. 4 and 5, are modular. That is to say, the decorative elements are interchangeable with other decorative elements. For example, the decorative element 12 shown in FIGS. 1 through 3 is engageable with the hook portion 24 on the earlobe L shown in FIG. 4. Likewise, the decorative element 52 shown in FIGS. 4 and 5 is engageable with the hook portion 24 on the earlobe L shown in FIG. 1. Hence, the decorative elements 12 and 52 may be interchanged without removing and replacing the hook portions 24 of the fastener 14 attached to the earlobe L.

As shown in FIG. 7, the component parts for the ear ornaments of the present invention, such as the ear ornaments 10 and 50, may be provided as part of a kit 60 according to the present invention. The kit 60 may include one or more decorative elements such as the decorative elements 12 and the decorative elements 52, and associated hook-and-loop-type fasteners 14. The kit may further include replacement hook and loop portions 24' and 26' for the hook-and-loop-type fasteners 14. It should be understood that the replacement hook portions 24' each would include an adhesive element 28, having a first adhesive surface 32 affixed to the respective hook portion 24' and a second adhesive surface 34 covered with a release paper 36. Similarly, the replacement loop portions 26' each would include an adhesive element 30 having a first adhesive surface 38 affixed to a respective loop portion 26' and a second adhesive surface 40 covered with a release paper 36. Selected styles of the decorative elements, such as the decorative element 12, may include a plate-like member 22 on the support region 20 on the rear portion 18 of the decorative element 12. It will be appreciated that the provision of the plate-like member 22 would make the decorative element 12 easily adapted to removal of used loop portions 26 of the fastener 14 and subsequent attachment of replacement loop portions 26'. It should be noted that the kit 60 may include myriad styles of decorative elements, including, for example, but not limited to, the decorative elements 12 and 52 shown in FIGS. 1 through 3 and FIGS. 4 and 5, respectively, and may include more than one of each style of decorative element. The kit 60 may be provided in any suitable package (not shown).

Figure 8:
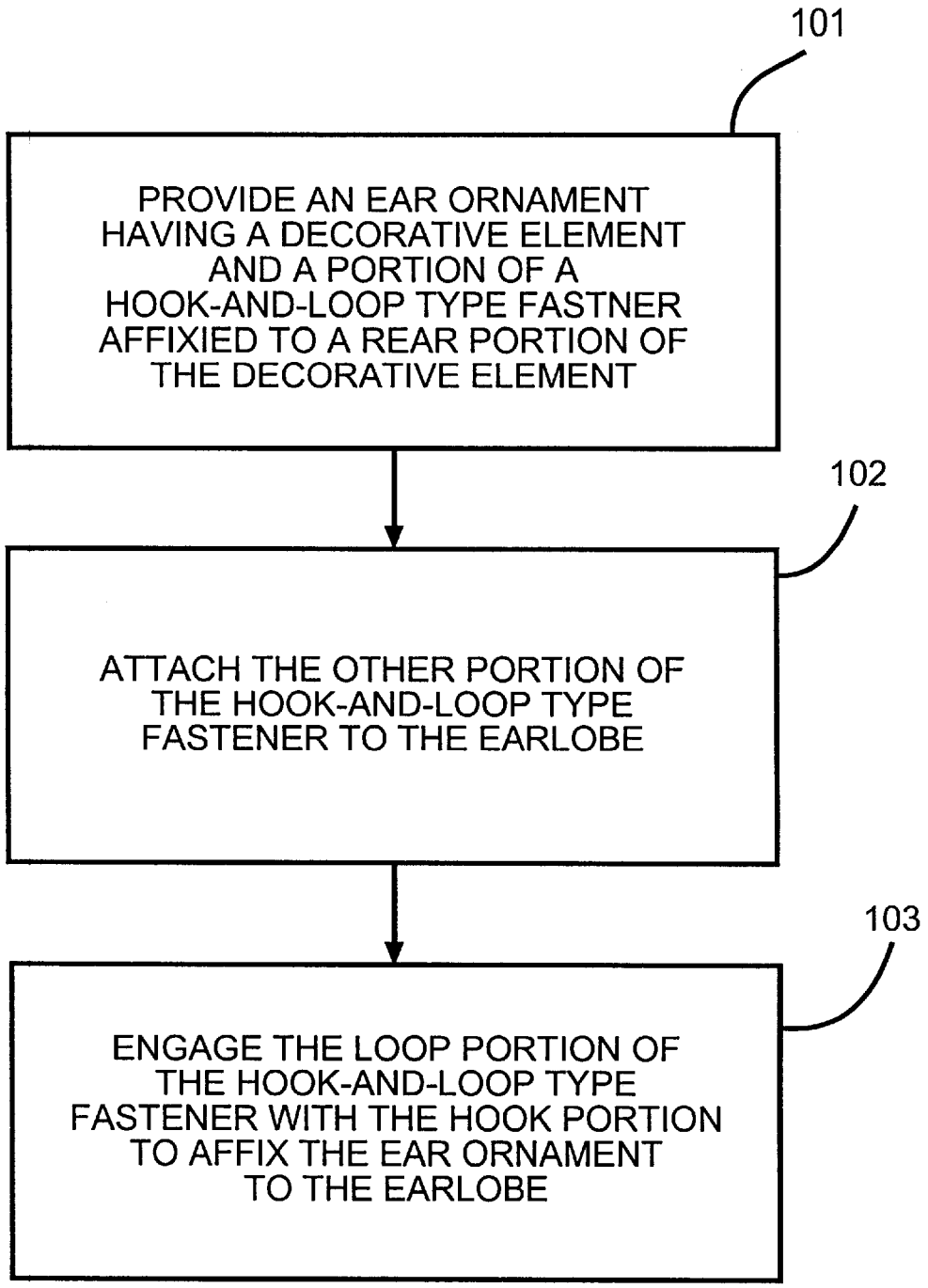
FIG. 8 is a diagrammatic representation of a method for attaching a body-worn ornament according to the present invention.

FIG. 8 illustrates a method for removably securing an car ornament according to the invention to a wearer's earlobe. A first step 101 of the method is to provide an ear ornament having a decorative element and a loop portion of a hook-and-loop-type fastener affixed to the decorative element. A second step 102 of the method is to attach a hook portion of the hook-and-loop-type fastener to an earlobe. A third step 103 of the method is to engage the loop portion with the hook portion.

In the preferred embodiment described with respect to FIGS. 1 through 3, the hook-and-loop-type fastener 14 is described as having the hook portion 24 fastened to the earlobe L and the loop portion 26 fastened to the decorative element 12 of the ear ornament 10. However, it is contemplated that this arrangement may be reversed. That is to say, the hook portion 24 may be fastened to the decorative element 12 and the loop portion 26 may be fastened to the earlobe L. It is also contemplated that the portion of the fastener 14 described above as being adhered to the earlobe L of the wearer may be adhered to any other portion of the wearer's body or skin.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An ear ornament comprising:

a plate member having first and second opposed surfaces;

a decorative element fixed to said first surface; and a hook-and-loop fastener including a hook portion and a loop portion, one of said hook portion and said loop portion being fixed to substantially all of said second surface, the other of said hook portion and said loop portion being provided with an adhesive surface whereby the other of said hook portion and said loop portion may be attached to a wearer's ear.

2. An ear ornament according to claim 1, wherein said decorative element is fabricated from a material sufficiently lightweight so as to be supported on the earlobe by said fastener.

3. An ear ornament according to claim 2, wherein said decorative element is fabricated from a cloth material.

4. An ear ornament according to claim 3, wherein said cloth material is a stain-resistant, washable cloth material.

5. An ear ornament according to claim 1 wherein said plate member is fabricated from a material that facilitates attachment and removal of said hook-and-loop fastener.

6. An ear ornament according to claim 1, further including:

a plurality of hook portions, each said hook portion being attachable to said earlobe, each said hook portion prior to being attached to said earlobe defining a new hook portion, each said hook portion subsequent to being attached to said earlobe defining a used hook portion, said used hook portions being removable from said earlobe and said new hook portions being attachable to said earlobe subsequent to removing said used hook portions from said earlobe.

7. An ear ornament according to claim 1, wherein said hook and loop portions are neutral or colorless in color so as to be substantially unnoticed against the earlobe.

8. An ear ornament according to claim 1, wherein said hook and loop portions are small relative to said decorative element so as to be concealed by said decorative element when said decorative element is attached to said earlobe.

9. An ear ornament according to claim 1, further including:

a plurality of interchangeable decorative elements.

10. An ear ornament according to claim 1, wherein said adhesive surface is coated with a substantially harmless, non-toxic adhesive material.

11. An ear ornament according to claim 1, wherein said decorative element defines a surface with a greater area than said second surface of said plate member, said decorative element being fixed to said first surface of said plate member on a portion of said surface of said decorative element.

12. An ear ornament according to claim 11, wherein said decorative element is fabricated from a cloth material.

13. An ear ornament according to claim 1, wherein said plate member is rigid.

14. An ear ornament according to claim 13, wherein said decorative element is fabricated from a material sufficiently lightweight so as to be supported on the earlobe by said fastener.

15. A method for removably securing a body-worn ornament to a wearer's body, the method comprising the steps of:

(a) providing a body-worn ornament comprising a decorative element, a plate member fixed to the decorative element, the plate member having a back side, and a hook-and-loop fastener having a hook portion and a loop portion, the loop portion being attached to the substantially all of the back side of the plate member;

(b) removably attaching the hook portion of the hook-and-loop fastener to a wearer's body; and (c) releasably engaging the loop portion of the hook-and-loop fastener with the hook portion.

16. A body ornament comprising:

a rigid plate member having first and second opposed surfaces;

a decorative element fixed to said first surface; and a hook-and-loop fastener including a hook portion and a loop portion, one of said hook portion and said loop portion being fixed to said second surface, the other of said hook portion and said loop portion being provided with an adhesive surface whereby the other of said hook portion and said loop portion may be attached to a wearer's body.

17. A body-worn ornament kit, comprising:

a body-worn ornament whose function is principally decorative, said body-worn ornament including a plate member and a decorative member fixed to said plate member;

a hook-and-loop fastener adapted to be fixed to said plate member of said ornament and to releasably fix said ornament to a user's body; and a plurality of replacement hook-and-loop fasteners that a user may use to replace said hook-and-loop fastener, each of said replacement hook-and-loop fasteners being substantially identical to said hook-and-loop fastener.

18. A body-worn ornament kit according to claim 17, wherein said decorative member has a rear portion and said plate member is fixed to said rear portion of said decorative member of said body-worn ornament.

19. A body-worn ornament kit according to claim 18 further comprising a plurality of decorative members.

20. An earring kit, comprising:

a decorative earring element;

a plate member fixed to said earring element;

a hook-and-loop fastener adapted to be fixed to said plate member and adapted to releasably fix said plate member to a wearer's ear; and a plurality of replacement hook and-loop fasteners substantially similar to said hook-and-loop fastener.

* * * * *